US011952649B2

(12) United States Patent
Jeon et al.

(10) Patent No.: US 11,952,649 B2
(45) Date of Patent: Apr. 9, 2024

(54) HIGH-STRENGTH STAINLESS STEEL

(71) Applicant: POSCO, Pohang-si (KR)

(72) Inventors: Jong Jin Jeon, Pohang-si (KR); Mi-Nam Park, Pohang-si (KR); Sang Seok Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 511 days.

(21) Appl. No.: 17/312,119

(22) PCT Filed: Aug. 23, 2019

(86) PCT No.: PCT/KR2019/010786

§ 371 (c)(1),
(2) Date: Jun. 9, 2021

(87) PCT Pub. No.: WO2020/130279

PCT Pub. Date: Jun. 25, 2020

(65) Prior Publication Data

US 2022/0033941 A1 Feb. 3, 2022

(30) Foreign Application Priority Data

Dec. 18, 2018 (KR) ..... 10-2018-0164564

(51) Int. Cl.
*C22C 38/44* (2006.01)
*C21D 6/00* (2006.01)
(Continued)

(52) U.S. Cl.
CPC ..... *C22C 38/44* (2013.01); *C21D 6/004* (2013.01); *C21D 6/005* (2013.01); *C21D 6/008* (2013.01);
(Continued)

(58) Field of Classification Search
CPC ..... C22C 38/44
See application file for complete search history.

(56) References Cited

U.S. PATENT DOCUMENTS 6,440,236 B1 8/2002 Hiramatsu et al.
6,488,786 B2 12/2002 Hiramatsu et al.
(Continued)

FOREIGN PATENT DOCUMENTS

GB 832562 4/1960
JP H08-134595 A 5/1996
(Continued)

OTHER PUBLICATIONS

Chinese Office Action dated Apr. 26, 2022 issued in Chinese Patent Application No. 201980083762.3 (with English translation).
(Continued)

*Primary Examiner* — Christopher S Kessler
(74) *Attorney, Agent, or Firm* — Morgan, Lewis & Bockius LLP

(57) ABSTRACT

A stainless steel with a yield strength of 2,200 MPa or more is disclosed through the generation of the strain-induced martensite phase and the increase of the martensite phase strength. A high strength stainless steel according to an embodiment of present disclosure includes, in percent (%) by weight of the entire composition, C: 0.14 to 0.20%, Si: 0.8 to 1.0%, Mn: more than 0 and 0.5% or less, Cr: 15.0 to 17.0%, Ni: 4.0 to 5.0%, Mo: 0.6 to 0.8%, Cu: 0.5% or less, N: 0.05 to 0.11%, the remainder of iron (Fe) and other inevitable impurities, and C+N: 0.25% or more and Md30 value satisfies 40° C. or more.

5 Claims, 3 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |

(52) U.S. Cl.
CPC ..... *C21D 8/0205* (2013.01); *C21D 8/0226* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/42* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2009/0041613 | A1* | 2/2009 | Suzuki | C22C 38/58 420/60 |
| 2018/0037970 | A1 | 2/2018 | Matsumura et al. | |

FOREIGN PATENT DOCUMENTS

| | | | |
|---|---|---|---|
| JP | 2001-107192 | A | 4/2001 |
| JP | 2003-193202 | A | 7/2003 |
| JP | 2004-018989 | A | 1/2004 |
| JP | 2008-248271 | A | 10/2008 |
| JP | 2011-202237 | A | 10/2011 |
| JP | 2017-066449 | A | 4/2017 |
| JP | WO2015-190422 | A1 | 4/2017 |
| JP | 2018-003139 | A | 1/2018 |
| KR | 101401625 | B1 | 6/2014 |
| KR | 101600251 | B1 | 3/2016 |
| KR | 101623290 | B1 | 5/2016 |
| WO | 2013/100687 | A1 | 7/2013 |
| WO | 2014/157146 | A1 | 10/2014 |

OTHER PUBLICATIONS

Extended European Search Report dated Feb. 3, 2022 issued in European Patent Application No. 19897657.3.
International Search Report dated Sep. 9, 2019 issued in International Patent Application No. PCT/KR2019/010786 (with English translation).
Korean Notice of Allowance dated Aug. 10, 2020 issued in Korean Patent Application No. 10-2018-0164564.
Korean Office Action dated Mar. 3, 2020 issued in Korean Patent Application No. 10-2018-0164564.

* cited by examiner

【FIG. 1】
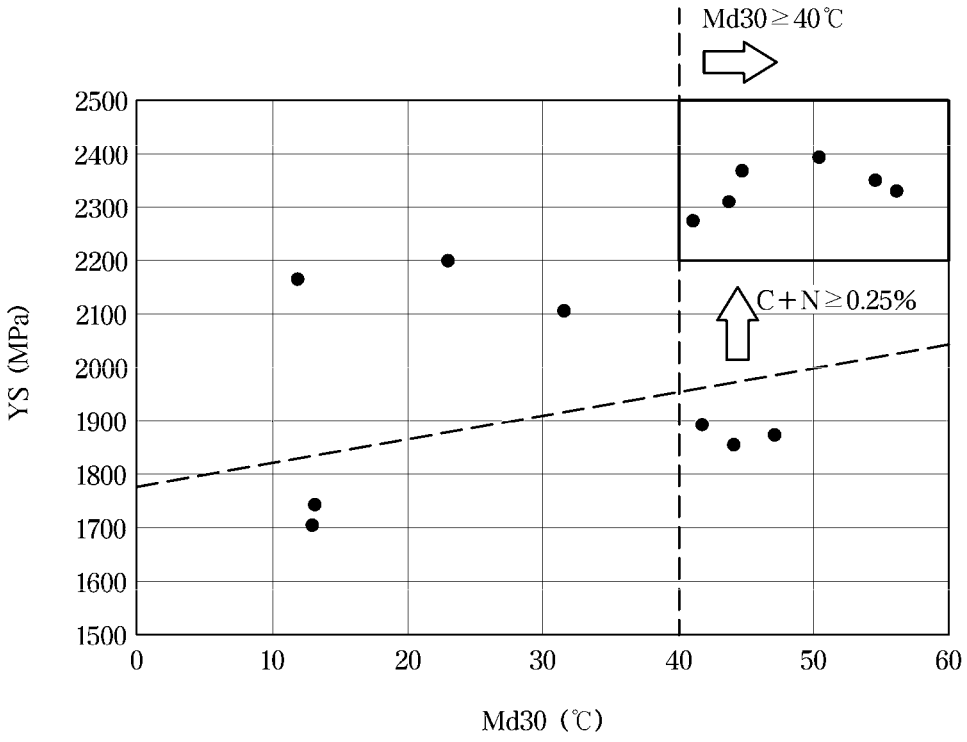

【FIG. 2】
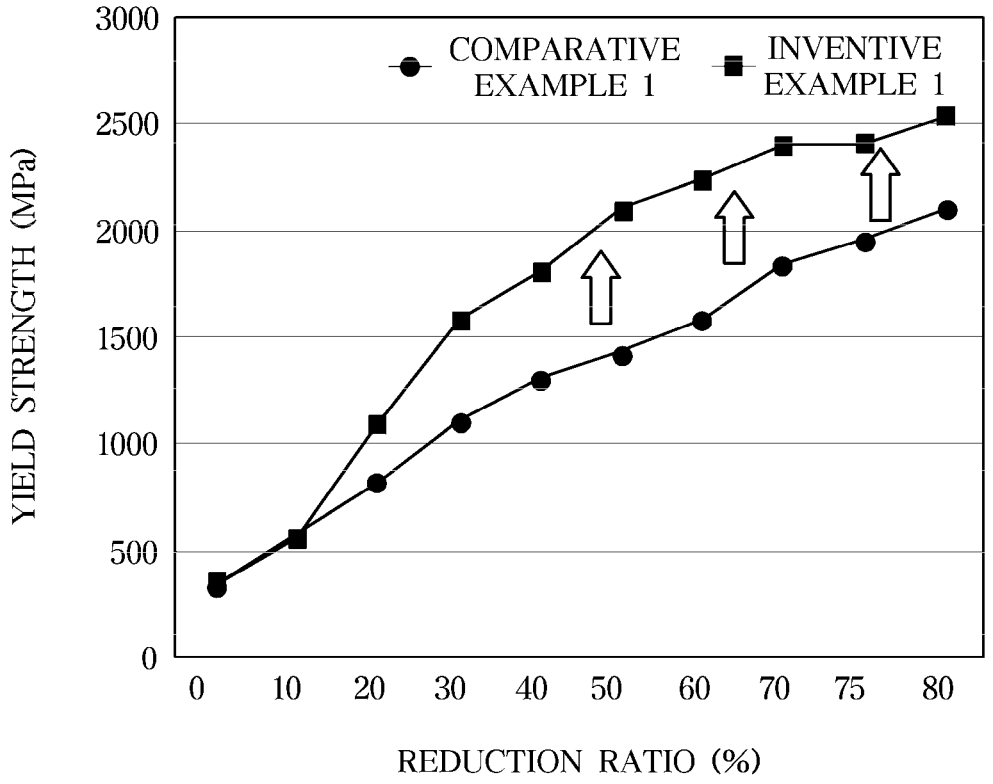

【FIG. 3】
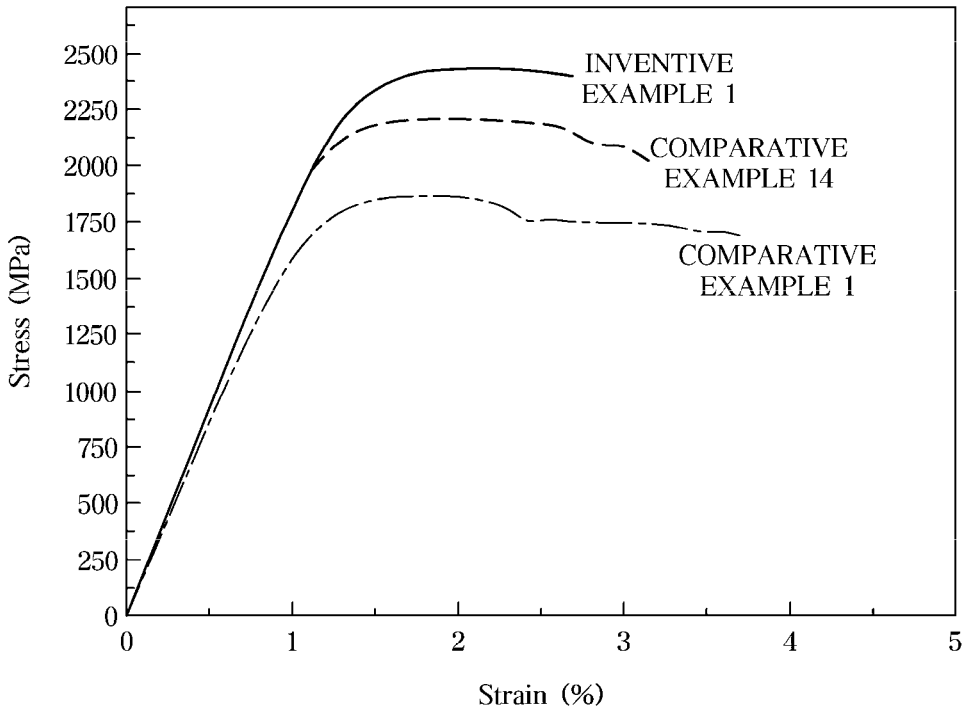

HIGH-STRENGTH STAINLESS STEEL

CROSS-REFERENCE OF RELATED APPLICATIONS

This application is the U.S. National Phase under 35 U.S.C. § 371 of International Patent Application No. PCT/KR2019/010786, filed on Aug. 23, 2019, which in turn claims the benefit of Korean Application No. 10-2018-0164564, filed on Dec. 18, 2018, the entire disclosures of which applications are incorporated by reference herein.

TECHNICAL FIELD

The present disclosure relates to a high-strength stainless steel, and more particularly, to stainless steel having excellent yield strength through the generation of strain-induced martensite phase and increase of martensite phase strength.

BACKGROUND ART

An austenitic stainless steel is a representative stainless steel that is most commonly used because of its excellent properties such as formability, corrosion resistance, and weldability. In particular, one of the characteristics of austenitic stainless steel is that it accompanies phase transformation during processing. In other words, if the austenite phase is not sufficiently maintained in a high alloy state with elements stabilizing the austenite phase, the austenite phase transforms into a martensite phase during plastic deformation, resulting in a large increase in strength. Among them, STS301 series stainless steel, one of the representative steel grades, is characterized by its high degree of work hardening according to plastic deformation due to unstable phase stability. For example, the yield strength of heat-treated STS301 steel is around 300 MPa, but when it is cold-rolled by 75% or more, the yield strength increases to 1,800 MPa by increasing the strain-induced martensite phase. Therefore, the STS301 series is a full hard material and has been used in fields requiring high elastic stress and high strength, such as automobile gaskets and springs.

Recently, the STS301 series of Full Hard material is being applied as the folding part of a foldable smartphone, and it is a trend to design a smaller radius of curvature of the folding part in consideration of the aesthetics of the exterior design. As the radius of curvature decreases, the thickness of the material of the folding part becomes thinner, and the yield strength of the material itself is required to be at least 2,000 MPa in order to compensate for the strength of the thinned material. Existing materials of the STS301 series are not easy to obtain a yield strength of 2,000 MPa or more even at a 75% cold reduction ratio. In addition, it is possible to secure a strength of 2,000 MPa or more at a cold reduction ratio of 85% or more, but it is difficult to secure flatness due to the presence of some residual stress after the final heat treatment. Therefore, it is necessary to develop a material with superior yield strength compared to the existing STS301 steel even at a reduction ratio of 75% or less.

DISCLOSURE

Technical Problem

The present disclosure provides stainless steel with superior yield strength of cold-rolled material compared to the existing STS301 series stainless steel by realizing an increase in strain-induced martensite phase fraction and martensite phase strength through alloy composition control.

Technical Solution

In accordance with an aspect of the present disclosure, a high strength stainless steel includes, in percent (%) by weight of the entire composition, C: 0.14 to 0.20%, Si: 0.8 to 1.0%, Mn: more than 0 and 0.5% or less, Cr: 15.0 to 17.0%, Ni: 4.0 to 5.0%, Mo: 0.6 to 0.8%, Cu: 0.5% or less, N: 0.05 to 0.11%, the remainder of iron (Fe) and other inevitable impurities, and C+N: 0.25% or more and Md30 value represented by a following Equation (1) satisfies 40° C. or more.

$$Md30(^\circ C.)=551-462*(C+N)-9.2*Si-8.1*Mn-13.7*Cr-29*(Ni+Cu)-18.5*Mo \quad (1)$$

Here, C, N, Si, Mn, Cr, Ni, Cu, Mo mean the content (% by weight) of each element.

A Ms value represented by a following Equation (2) may satisfy −110° C. or less.

$$Ms(^\circ C.)=502-810*C-1230*N-13*Mn-30*Ni-12*Cr-54*Cu-46*Mo \quad (2)$$

The Ms value represented by the Equation (2) may satisfy −117° C. or less, or a value of a following Equation (3) may satisfy 17.0 or more.

$$Ni/(C+N) \quad (3)$$

A matrix structure may include, as an area fraction, a martensite phase of 45% or more, a residual austenite phase and ferrite phase, and the ferrite phase may be 4% or less.

The stainless steel may be a cold rolled material with a reduction ratio of 60% or more, and may have a yield strength of 2,200 MPa or more.

Advantageous Effects

The high-strength stainless steel according to the embodiment of the present disclosure may exhibit high strength and excellent fatigue characteristics with a yield strength of 2,200 MPa or more of a cold-rolled material with a reduction ratio of 60%.

DESCRIPTION OF DRAWINGS

FIG. 1 is a graph showing a correlation between Md30, (C+N) content and yield strength (YS).

FIG. 2 is a graph showing the yield strength of Comparative Example 1 and Inventive Example 1 according to a reduction ratio.

FIG. 3 is a graph showing stress-strain curves of Inventive Example according to an embodiment of the present disclosure and Comparative Example.

BEST MODE

A high strength stainless steel according to an embodiment of the present disclosure includes, in percent (%) by weight of the entire composition, C: 0.14 to 0.20%, Si: 0.8 to 1.0%, Mn: more than 0 and 0.5% or less, Cr: 15.0 to 17.0%, Ni: 4.0 to 5.0%, Mo: 0.6 to 0.8%, Cu: 0.5% or less, N: 0.05 to 0.11%, the remainder of iron (Fe) and other inevitable impurities, and C+N: 0.25% or more and Md30 value represented by a following Equation (1) satisfies 40° C. or more.

$$Md30(^\circ C.)=551-462*(C+N)-9.2*Si-8.1*Mn-13.7*Cr-29*(Ni+Cu)-18.5*Mo \quad (1)$$

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Recently, miniaturization and thinning are in progress for application to folding parts or spring of foldable smart phone. This small and thin steel sheet material requires a small radius of curvature and excellent elastic stress and fatigue characteristics against stress fluctuating in the load direction. In particular, fatigue failure is a type of failure that occurs when a stress fluctuating in the load direction is repeated, and occurs even when the stress is below the elastic limit and is characterized by not accompanied by a plastic deformation that can be perceived macroscopically. In order to improve the fatigue characteristics, it is essentially necessary to increase the strength of the material so that the elastic limit stress can increase proportionally.

For use in these applications, metastable austenitic stainless steel hardened by the martensite phase transformation of the austenite phase by cold working is suitable. Therefore, in the present disclosure, strain-induced martensite phase transformation is induced during deformation by limiting the temperature range of Md30 by optimizing the content of the austenite stabilizing element, and the C+N content is controlled to secure the strength of the final cold-rolled material.

The high yield strength implementation method according to the present disclosure consists of (1) controlling Md30 to 40° C. or more to increase the strain-induced martensite phase fraction, and (2) containing C+N of 0.25% or more to increase the martensite phase strength.

A high strength stainless steel according to an embodiment of the present disclosure includes, in percent (%) by weight of the entire composition, C: 0.14 to 0.20%, Si: 0.8 to 1.0%, Mn: more than 0 and 0.5% or less, Cr: 15.0 to 17.0%, Ni: 4.0 to 5.0%, Mo: 0.6 to 0.8%, Cu: 0.5% or less, N: 0.05 to 0.11%, the remainder of iron (Fe) and other inevitable impurities.

Hereinafter, the reason for limiting the numerical value of the alloy element content in the embodiment of the present disclosure is described. Hereinafter, unless otherwise specified, the unit is % by weight.

The content of C is 0.14 to 0.20%.

C is an austenite phase forming element, and is an element that is effective in increasing material strength due to solid solution strengthening. In addition, since it greatly contributes to the reinforcing effect even during the transformation of the martensite phase during processing, it is preferable to add 0.14% or more to secure a yield strength of 2,200 MPa or more at a reduction ratio of 60% or more. However, in the case of excessive addition, during material manufacturing, segregation and coarse carbide are formed in the center, which adversely affects the hot rolling-annealing-cold rolling-cold rolling annealing process, which are a post process. In addition, since it is easily combined with a carbide-forming element such as Cr, which is effective in corrosion resistance, and reduces the corrosion resistance by lowering the Cr content around the grain boundaries, it is preferable to add within the range of 0.2% or less to maximize the corrosion resistance.

The content of Si is 0.8 to 1.0%.

Si is partially added for the deoxidation effect, and 0.8% or more is preferably added for the purpose of solid solution strengthening. If excessive, it lowers the slag fluidity during steel making, and reduces corrosion resistance by forming inclusions by combining with oxygen. Therefore, the Si content is preferably limited to 0.8 to 1.0%.

The content of Mn is more than 0 and 0.5% or less.

When the content of Mn is high, the solubility of N is improved. However, if the content is excessive, it combines with S in the steel to form MnS and not only lowers the corrosion resistance, but also lowers the hot workability. Therefore, it is preferable to limit the content of Mn to 0.5% or less.

The content of Cr is 15.0 to 17.0%.

Cr is an essential element for securing corrosion resistance of stainless steel. Increasing the content increases the corrosion resistance, but the strain-induced martensite phase fraction decreases due to lower Md30, making it difficult to secure strength. Therefore, in order to secure the corrosion resistance and strength of stainless steel, the content of Cr is limited to 15.0 to 17.0%.

The content of Ni is 4.0 to 5.0%.

Ni, along with Mn and N, is an austenite stabilizing element and plays a major role in Md30 control. If the Ni content is too low, the austenite phase stability is poor, and there is a possibility that a thermal martensite phase is formed during the cooling process. Conversely, an excessive increase in Ni content decreases the strain-induced martensite phase fraction due to lower Md30, thus limiting the Ni content to 4.0 to 5.0%.

The content of Mo is 0.6 to 0.8%.

Mo, along with Cr, is an essential element for securing corrosion resistance and greatly contributes to the solid solution strengthening effect. However, it is preferable to limit the content of Mo to 0.6 to 0.8%, since it may cause deterioration in hot workability when excessive.

The content of Cu is 0.5% or less.

Like Ni, Cu is an austenite phase stabilizing element and has an effect of softening the material, so it is preferable to control it to 0.5% or less.

The content of N is 0.05 to 0.11%.

Like C, N is an element that forms an austenite phase and is an effective element for improving the strength of materials by solid solution strengthening. At the same time, it greatly contributes to the strengthening effect even during strain-induced martensite phase transformation, so it is necessary to add 0.05% or more. However, it is preferable to limit it to 0.11% or less since excessive addition may cause surface cracking due to the formation of N pores.

In addition, according to an embodiment of the present disclosure, the C+N content satisfies 0.25% or more.

In cold-rolled material with a reduction ratio of 60% or more, in order to achieve a yield strength of 2,200 MPa or more for the present disclosure, it is required to secure a strain-induced martensite phase fraction according to Md30, which will be described later, and increase the strength. By controlling the C+N content to 0.25% or more, it is possible to increase the strength of the strain-induced martensite phase. Even if each range of 0.14 to 0.2% of C and 0.05 to 0.11% of N is satisfied, when the C+N content is less than 0.25%, it is difficult to secure a yield strength of 2,200 MPa or more of the final cold-rolled material.

Excluding the above alloying elements, the rest of stainless steel is made of Fe and other inevitable impurities.

In addition, according to an embodiment of the present disclosure, the Md30 value represented by the following Equation (1) satisfies 40° C. or higher, and a matrix structure includes, as an area fraction, a strain-induced martensite phase of 45% or more, a residual austenite phase and ferrite phase.

$$Md30(^\circ C.)=551-462*(C+N)-9.2*Si-8.1*Mn-13.7*Cr-29*(Ni+Cu)-18.5*Mo \quad (1)$$

In metastable austenitic stainless steel, martensitic transformation occurs by plastic working at a temperature above the martensitic transformation initiation temperature (Ms). The upper limit temperature that causes phase transformation by such processing is indicated by the Md value, and in particular, the temperature (° C.) at which 50% phase transformation to martensite occurs when 30% strain is applied is referred to as Md30. When the Md30 value is high, it is easy to generate the strain-induced martensite phase, whereas when the Md30 value is low, the strain-induced martensite phase is relatively difficult to form. This Md30 value is used as an index to determine the austenite stabilization degree of metastable austenitic stainless steel.

On the correlation between conventional Md30 and fatigue characteristics, there has been a study that the tendency to transform from the austenite phase to the strain-induced martensite phase during deformation has the greatest effect on the fatigue characteristics of the material. However, improvement of fatigue characteristics is insufficient only with Md30 control in an appropriate range, and it is confirmed that it has a greater proportionality in relation to strength. Even if a certain amount of strain-induced martensite phase is generated with the same processing history for the same Md30 value, it is difficult to expect a large improvement in fatigue characteristics unless the strength is secured. In general, this is because a material with high strength has a high elastic limit stress and has excellent fatigue characteristics.

For high-strength stainless steel according to the present disclosure, by controlling the Md30 value to 40° C. or higher based on the above-described alloy composition, the strain-induced martensite phase area fraction of cold-rolled material with a reduction ratio of 60% or more may be secured by 45% or more. In addition, the strength of the martensite phase is secured by controlling the above-described C+N content to 0.25% or more.

The matrix structure other than the martensite phase includes an austenite phase and some ferrite phase, and specifically consists of ferrite phase of 4% or less, which was formed as the initial tissue before cold rolling, and the rest of the metastable austenite phase.

Accordingly, the high-strength stainless steel of the present disclosure may exhibit a yield strength of 2,200 MPa or more of a cold-rolled material with a reduction ratio of 60% or more. More preferably, it can exhibit a yield strength of 2,300 MPa or more in a cold-rolled material with a 70% reduction ratio.

FIG. 1 is a graph showing a correlation between Md30, (C+N) content and yield strength (YS). Referring to FIG. 1, when the Md30 value of Equation (1) and the C+N content satisfy the range of the present disclosure, it can be seen that the yield strength of the final cold-rolled material is 2,200 MPa or more.

In addition, according to an embodiment of the present disclosure, the Ms value represented by the following Equation (2) may satisfy −110° C. or less.

$$Ms(^\circ C.)=502-810*C-1230*N-13*Mn-30*Ni-12*Cr-54*Cu-46*Mo \quad (2)$$

By controlling the martensitic transformation initiation temperature Ms to −110° C. or less, it is possible to suppress the formation of a thermal martensite phase during cooling. When thermal martensite is generated with the initial structure of ferrite, in cold rolling, it becomes impossible to roll with a reduction ratio of 60% or more due to brittleness problems.

On the other hand, even if the Ms value is −110° C. or less, a thermal martensite phase may be generated during the cooling process. This is because the Ms prediction formula of Equation (2) varies greatly depending on the Ni content, and to compensate for this, a ratio of Ni and C+N, which is a major austenite stabilizing element, was introduced.

According to an embodiment of the present disclosure, the Ms value represented by Equation (2) may satisfy −117° C. or less, or the value of Equation (3) may satisfy 17.0 or more.

$$Ni/(C+N) \quad (3)$$

When the Ni content is low, the austenite phase stability is lowered, and accordingly, even if the Ms value is sufficiently low, there is a concern that thermal martensite may be generated. It is difficult to express all the dependence of the formation of the thermal martensite phase upon cooling with only the Ms value, which means that it is complexly dependent on the Ni and C+N content, especially the Ni content. Therefore, in order to suppress the formation of the thermal martensite phase, it is preferable to satisfy at least one of the Ms value −117° C. or less or the Ni/(C+N) value of 17.0 or more.

The high-strength stainless steel according to an embodiment of the present disclosure may be manufactured by the general stainless steel manufacturing process of hot rolling-annealing-cold rolling. After hot rolling, water cooling may be performed after maintaining it within 10 minutes at a temperature range of 1,050 to 1,100° C., and cold rolling may be performed with a reduction ratio of 60% or more.

As described above, even if water cooling is performed during annealing after hot rolling, a thermal martensite phase is not formed in the cooling process, and a strain-induced martensite phase fraction can be secured by cold rolling.

Hereinafter, it will be described in more detail through a preferred embodiment of the present disclosure.

EXAMPLE

First, it was attempted to check whether it can achieve a yield strength of 2,200 MPa or more, which is the target property to be achieved in the present disclosure. It was compared with Comparative Example 1, which belongs to the existing 301 steel component range, and Inventive Example 1 was designed to satisfy the component system, C+N and Md30 ranges according to the present disclosure.

TABLE 1

| | C | Si | Mn | Cr | Ni | Mo | Cu | N | C + N | Md30 |
|---|---|---|---|---|---|---|---|---|---|---|
| Comparative Example 1 | 0.103 | 1.11 | 1.11 | 17.1 | 6.5 | 0.7 | 0.2 | 0.064 | 0.167 | 13.1 |
| Inventive Example 1 | 0.157 | 0.93 | 0.3 | 15.8 | 5 | 0.71 | 0.2 | 0.094 | 0.251 | 43.7 |

For Comparative Example 1 and Inventive Example 1 above, the yield strength according to the cold rolling reduction ratio was measured and shown in Table 2 below.

TABLE 2

| | Reduction ratio | Yield strength (MPa) |
|---|---|---|
| Comparative Example 1 | 0% | 341 |
| | 10% | 581 |
| | 20% | 836 |
| | 30% | 1,118 |
| | 40% | 1,316 |
| | 50% | 1,437 |
| | 60% | 1,592 |
| | 70% | 1,742 |
| | 75% | 1,969 |
| | 80% | 2,111 |
| Inventive Example 1 | 0% | 368 |
| | 10% | 560 |
| | 20% | 1,104 |
| | 30% | 1,587 |
| | 40% | 1,820 |
| | 50% | 2,107 |
| | 60% | 2,253 |
| | 70% | 2,311 |
| | 75% | 2,424 |
| | 80% | 2,548 |

Comparative Example 1, corresponding to the existing 301 steel grade, showed a yield strength of 2,000 MPa or more only when the 80% cold rolling reduction ratio was reached. Even 301 steel with a high work hardening rate showed a yield strength of less than 1,600 MPa at a reduction ratio of 60%.

On the other hand, Inventive Example 1 according to the present disclosure showed a yield strength of 2,200 MPa or more at a 60% reduction ratio, and a yield strength of 2,400 MPa at a 75% reduction ratio.

FIG. 2 is a graph showing the yield strength of Comparative Example 1 and Inventive Example 1 according to the reduction ratio based on the data in Table 2. Referring to FIG. 2, it can be seen that the strength increased according to the reduction ratio of Inventive Example 1 compared to Comparative Example 1. As such, it was confirmed that the purpose of present disclosure to increase the strength of the strain-induced martensite phase generated by sufficiently forming the strain-induced martensite phase through Md30 control and satisfying the C+N content can be achieved.

Next, to examine the technical/critical significance of each range, such as the content of each alloy element in the component system, Md30 accordingly, and the ferrite phase and martensite phase generated in the manufacturing process, the stainless steel of the component system shown in Table 3 below was prepared as an ingot by Lab. vacuum melting. After checking whether or not N pores were generated in the prepared ingot, it was reheated and hot-rolled, and annealing was performed at a temperature of 1,050 to 1,100° C., and the initial ferrite fraction was measured using a ferrite scope. After that, the strain-induced martensite phase fraction and yield strength were measured by cold rolling to a final reduction ratio of 70%.

TABLE 3

| | C | Si | Mn | Cr | Ni | Mo | Cu | N | C + N |
|---|---|---|---|---|---|---|---|---|---|
| Comparative Example 1 | 0.103 | 1.11 | 1.11 | 17.1 | 6.5 | 0.7 | 0.2 | 0.064 | 0.167 |
| Comparative Example 2 | 0.081 | 0.89 | 1.11 | 17 | 6.4 | 0.7 | 0.2 | 0.1 | 0.181 |
| Comparative Example 3 | 0.078 | 0.87 | 1.1 | 17 | 6.4 | 0.68 | 0.21 | 0.03 | 0.108 |
| Comparative Example 4 | 0.081 | 0.29 | 0.29 | 15.8 | 6.6 | 0 | 0.2 | 0.11 | 0.191 |
| Comparative Example 5 | 0.082 | 0.88 | 0.3 | 15.9 | 6.1 | 0.74 | 0.2 | 0.101 | 0.183 |
| Comparative Example 6 | 0.154 | 0.89 | 0.3 | 16 | 6 | 0.71 | 0.2 | 0.098 | 0.252 |
| Comparative Example 7 | 0.203 | 0.89 | 0.3 | 15.8 | 5 | 0.71 | 0.21 | 0.093 | 0.296 |
| Comparative Example 8 | 0.149 | 0.9 | 0.31 | 16.1 | 4 | 0.7 | 0.2 | 0.092 | 0.241 |
| Comparative Example 9 | 0.199 | 0.9 | 0.31 | 16.1 | 2.96 | 0.69 | 0.2 | 0.105 | 0.304 |
| Inventive Example 1 | 0.157 | 0.93 | 0.3 | 15.8 | 5 | 0.71 | 0.2 | 0.094 | 0.251 |
| Inventive Example 2 | 0.196 | 0.9 | 0.3 | 15.9 | 4.1 | 0.68 | 0.2 | 0.096 | 0.292 |
| Comparative Example 10 | 0.13 | 0.89 | 0.31 | 16 | 4.9 | 0.72 | 0.19 | 0.12 | 0.25 |
| Comparative Example 11 | 0.125 | 0.9 | 0.31 | 15.9 | 5 | 0.69 | 0.2 | 0.13 | 0.255 |
| Comparative Example 12 | 0.128 | 0.89 | 0.29 | 16.1 | 4.5 | 0.7 | 0.2 | 0.12 | 0.248 |
| Comparative Example 13 | 0.115 | 0.9 | 0.29 | 16 | 4.5 | 0.68 | 0.2 | 0.14 | 0.255 |
| Comparative Example 14 | 0.088 | 0.93 | 0.3 | 16.2 | 5.1 | 0.77 | 0.18 | 0.17 | 0.258 |

As shown in Table 3, in order to secure corrosion resistance, the experimental steel grades were fixed in the range of 15.0 to 17.0% for Cr and 0.7% for Mo, and the contents of C, Mn, Ni, and N that affect the austenite phase stability were changed.

Accordingly, Md30, Ms, Ni/(C+N), initial ferrite phase (α) fraction, N Pore formation, strain-induced martensite phase (α') fraction at 70% of cold rolling reduction ratio and yield strength (YS) are shown in Table 4 below.

TABLE 4

| | Md30 (° C.) | Ms (° C.) | Ni/(C + N) | α phase fraction (area %) | N Pore formation | Strain-induced α' phase fraction (area %) | Yield strength (MPa) |
|---|---|---|---|---|---|---|---|
| Comparative Example 1 | 13.1 | −117.8 | 38.9 | 0.6 | x | 28.9 | 1,742 |
| Comparative Example 2 | 47.0 | −51.0 | 59.3 | 3.7 | x | 53.7 | 1,873 |
| Comparative Example 3 | 12.9 | −140.0 | 35.4 | 1.7 | x | 30.0 | 1,704 |
| Comparative Example 4 | 44.1 | −101.1 | 34.6 | 3.1 | x | 46.2 | 1,853 |
| Comparative Example 5 | 41.7 | −111.2 | 33.3 | 1.8 | x | 47.6 | 1,894 |
| Comparative Example 6 | 11.8 | −162.6 | 23.8 | 1.0 | x | 34.8 | 2,165 |
| Comparative Example 7 | 22.9 | −164.3 | 16.9 | 1.7 | x | 41.2 | 2,199 |
| Comparative Example 8 | 73.5 | −92.1 | 16.6 | 31.4 (α' phase formation) | x | — | — |
| Comparative Example 9 | 74.8 | −116.9 | 9.7 | 10.9 (α' phase formation) | x | — | — |
| Inventive Example 1 | 43.7 | −127.8 | 19.9 | 3.3 | x | 57.1 | 2,311 |
| Inventive Example 2 | 50.3 | −134.6 | 14.0 | 1.9 | x | 52.3 | 2,394 |
| Comparative Example 10 | 44.7 | −137.3 | 19.6 | 1.9 | ○ | 54.5 | 2,369 |
| Comparative Example 11 | 41.0 | −146.5 | 19.6 | 1.9 | ○ | 53.8 | 2,275 |
| Comparative Example 12 | 56.1 | −124.3 | 18.1 | 3.9 | ○ | 63.0 | 2,331 |
| Comparative Example 13 | 54.5 | −136.2 | 17.6 | 3.4 | ○ | 57.8 | 2,351 |
| Comparative Example 14 | 31.5 | −174.8 | 19.8 | 3.9 | ○ | 54.6 | 2,106 |

FIG. 3 is a graph showing stress-strain curves of Inventive Example according to an embodiment of the present disclosure and Comparative Example. It will be described with reference to FIG. 3 and Tables 3 and 4.

Comparative Examples 1 to 5 show a high Ni/(C+N) value because the Ni content is as high as 6.0% or more, and the C+N content is less than 0.2%.

In Comparative Examples 1 and 2, since the austenite stability was high due to the low Md30 value, the strain-induced martensite phase was 30.0% or less after cold rolling, but Comparative Examples 3 to 5 showed that the strain-induced martensite phase was generated more than or equal to 45% after 70% cold rolling as the Md30 value satisfied 40° C. or more.

However, as shown in FIG. 3, Comparative Examples 3 to 5 did not satisfy the C+N content of 0.25% or more. Therefore, it can be seen that even though the Md30 value satisfies 40° C. or higher, the yield strength of the final cold-rolled material is low at the level of 1,900 MPa.

Comparative Example 6 has a high Ni content of 6.0%, but satisfies a C+N content of 0.25% or more. Satisfying the C+N range, the yield strength of the final cold-rolled material was 2,165 MPa, which was close to 2,200 MPa, but the Md30 value was very low, resulting in less strain-induced martensite phase after cold rolling. Comparative Example 7, as in Comparative Example 6, also showed a high yield strength of 2,199 MPa as the C+N content was 0.25% or more, but the strain-induced martensite phase was not sufficiently formed after cold rolling due to the low Md30 value.

As can be seen from Comparative Examples 6 and 7, when the C+N content is 0.25% or more, but the Md30 value is low, the yield strength does not exceed 2,200 MPa. That is, it can be seen that high yield strength of 2,200 MPa or more can be realized by controlling Md30 to increase the strain-induced martensite phase fraction to 45% or more, and by increasing the C+N content to improve the strength of the martensite phase itself.

Comparative Examples 8 and 9 show cases in which thermal martensite was generated during cooling. In Comparative Example 8, the Ms value was higher than −110° C., resulting in the formation of thermal martensite, and although the C+N content was somewhat low, the final yield strength could not be measured because cold rolling was impossible due to the formation of thermal martensite. In Comparative Example 9, cold rolling was impossible due to the formation of thermal martensite.

Looking at the Ms values of Comparative Examples 8 and 9, in Comparative Example 9, it can be seen that the thermal martensite phase was generated even though the Ms value was −116.9° C., which is lower than −110° C. This means that, as described above, it is difficult to express all the dependence of the generation of the thermal martensite phase upon cooling with only the Ms value, and it is complexly dependent on the Ni and C+N content, especially the Ni content. Even when the Ms value is −110° C. or less, if the Ni/(C+N) value is 17.0 or less, it was confirmed that a thermal martensite phase may be generated due to insufficient Ni content. That is, even if the Ms value is −110° C. or less, thermal martensite may be generated when the Ms value is −117° C. or more and the Ni/(C+N) value is 17.0 or less.

On the other hand, in Comparative Example 3, although the Ms value was quite high at −51° C., thermal martensite was not generated during the cooling process, which was presumed to be due to the high Ni/(C+N) value due to the high Ni content.

For Inventive Examples 1 and 2, all alloy compositions in the present disclosure are satisfied, and the strain-induced martensite of 45% or more was produced after 70% cold rolling according to the Md30 value of 40° C. or more. In addition, the C+N content was contained in an appropriate amount of 0.251% and 0.292%, respectively, and as shown in FIGS. 1 and 2, the yield strength of the final cold-rolled material was measured to be 2,300 MPa or more.

In Comparative Examples 10 to 14, the N content exceeded 0.11%, and N Pore was generated in the ingot. Even though the C content is low, since the N content is high, C+N satisfies approximately 0.25% or more and has excellent yield strength, but surface cracks were found due to the formation of N Pore in the steel surface layer.

In the above description, exemplary embodiments of the present disclosure have been described, but the present disclosure is not limited thereto. Those of ordinary skill in the art will appreciate that various changes and modifications can be made without departing from the concept and scope of the following claims.

INDUSTRIAL APPLICABILITY

The high-strength stainless steel according to the present disclosure can exhibit high strength and excellent fatigue characteristics, and thus can be used as a foldable-type display back-plate material.

The invention claimed is:

1. A high strength stainless steel comprising, in percent (%) by weight of the entire composition, C: 0.14 to 0.20%, Si: 0.8 to 1.0%, Mn: more than 0 and 0.5% or less, Cr: 15.0 to 17.0%, Ni: 4.0 to 5.0%, Mo: 0.6 to 0.8%, Cu: 0.5% or less, N: 0.05 to 0.11%, the remainder of iron (Fe) and other inevitable impurities, and C+N: 0.25% or more and Md30 value represented by a following Equation (1) satisfies 40° C. or more $$Md30(^\circ C.)=551-462*(C+N)-9.2*Si-8.1*Mn-13.7*Cr-29*(Ni+Cu)-18.5*Mo \quad (1)$$

(Here, C, N, Si, Mn, Cr, Ni, Cu, Mo mean the content (% by weight) of each element).

2. The high strength stainless steel of claim 1, wherein a Ms value represented by a following Equation (2) satisfies −110° C. or less $$Ms(^\circ C.)=502-810*C-1230*N-13*Mn-30*Ni-12*Cr-54*Cu-46*Mo \quad (2).$$

3. The high strength stainless steel of claim 2, wherein the Ms value represented by the Equation (2) satisfies −117° C. or less, or a value of a following Equation (3) satisfies 17.0 or more $$Ni/(C+N) \quad (3).$$

4. The high strength stainless steel of claim 1, wherein a matrix structure comprises, as an area fraction, a martensite phase of 45% or more, a residual austenite phase and ferrite phase, and the ferrite phase is 4% or less.

5. The high strength stainless steel of claim 1, wherein the stainless steel is a cold rolled material with a reduction ratio of 60% or more, and has a yield strength of 2,200 MPa or more.

* * * * *